US012404729B2

(12) United States Patent
Fulks

(10) Patent No.: US 12,404,729 B2
(45) Date of Patent: Sep. 2, 2025

(54) OMNIDIRECTIONAL SLIP BOWL

(71) Applicant: Consolidated Rig Works, L.P., Fort Worth, TX (US)

(72) Inventor: Caleb E.M. Fulks, McKinney, TX (US)

(73) Assignee: Consolidated Rig Works, L.P., Fort Worth, TX (US)

( * ) Notice: Subject to any disclaimer, the term of this patent is extended or adjusted under 35 U.S.C. 154(b) by 137 days.

(21) Appl. No.: 18/362,534

(22) Filed: Jul. 31, 2023

(65) Prior Publication Data

US 2025/0043641 A1 Feb. 6, 2025

(51) Int. Cl.
*E21B 19/10* (2006.01)

(52) U.S. Cl.
CPC ..... *E21B 19/10* (2013.01)

(58) Field of Classification Search
CPC ..... E21B 19/10
See application file for complete search history.

(56) References Cited

U.S. PATENT DOCUMENTS 1,803,608 A * 5/1931 Goetz ..... E21B 19/10 188/67
4,828,293 A * 5/1989 Vanderford, Jr. ... E21B 33/0422 285/123.6
2010/0116558 A1* 5/2010 Angelle ..... E21B 19/16 175/423
2015/0159445 A1* 6/2015 Smith ..... E21B 19/24 166/382

* cited by examiner

*Primary Examiner* — Blake Michener

(57) ABSTRACT

An omnidirectional slip bowl includes a support frame having a central axis and defining an opening therein to receive an oilfield tubular passing into or coming out of a wellbore. A plurality of pivot arms moves between an open configuration and a closed configuration. A plurality of actuating mechanisms each having a first end connected to one of the plurality of pivot arms, wherein each of the plurality of actuating mechanisms moves the associated pivot arm between the open configuration and the closed configuration. A plurality of gripping assemblies each associated with one of the plurality of pivot arms lock the tubular in a fixed position and prevent movement of the tubular from moving into or out of the wellbore. When the plurality of pivot arms are in the closed configuration and the tubular is moving out of the wellbore, the plurality of gripping assemblies move in a first direction along the pivot arm and engage the tubular to prevent moving out of the wellbore. When the plurality of pivot arms are in the closed configuration and the tubular is moving into the wellbore, the plurality of gripping assemblies move in a second direction along the pivot arm and engage the tubular to prevent moving into the wellbore.

20 Claims, 8 Drawing Sheets

OMNIDIRECTIONAL SLIP BOWL

TECHNICAL FIELD

The present invention relates to slip bowls for snubbing equipment and hydraulic work over units, and more particularly, to a slip bowl that can prevent oilfield tubulars used downhole from movement in both the in-hole direction and the out-of-hole direction simultaneously.

BACKGROUND

A slip bowl is used to maintain control over oilfield tubulars such as drill string, production pipe, or well bore casing as they are being introduced into or removed from a well bore. For purposes of this application, unless otherwise indicated the term "tubulars" and "oilfield tubulars" refer to drill pipe, drill strings, production pipe, production strings, jointed pipe and collars, jointed and continuous tubing, casing and other types of oilfield tubular members and strings formed of such tubular members. Slip bowls have been an integral part of the snubbing service industry for the past 50 years. Existing sizes and styles of traditional slip bowls are designed to support pipe weight in only one direction. The slip bowl operates as a mechanical check valve, allowing pipe to move freely in one direction but not in the opposite direction when the bowl is closed. Current designs require snubbing units to have a set of two slip bowls. Each set has one bowl right side up to handle pipe-heavy weight (i.e., load directed down into the well bore when the pipe weight exceeds the force from well pressure) and one bowl upside down to handle pipe-light weight (i.e., load directed out of the well bore when the force from well pressure exceeds the pipe weight). Thus, two bowls are required to hold the pipe in two directions. Additionally, traditional slip bowls are not rated to handle rotational torque loads. Thus, there is a need for a new type of slip bowl that has the capability of supporting drill pipe in both axial directions and to transmit rotational loads.

SUMMARY

The present invention, as disclosed and described herein, in one aspect thereof comprises an omnidirectional slip bowl including a support frame having a central axis and defining an opening therein to receive an oilfield tubular passing into or coming out of a wellbore. A plurality of pivot arms move between an open configuration and a closed configuration. A plurality of cylinder mounts slidably engage the support frame and move between the open configuration and the closed configuration. Each of the plurality of cylinder mounts are associated with one of the plurality of pivot arms. A plurality of actuating mechanisms each associated with one of the plurality of pivot arms have a first end connected to one of the plurality of pivot arms and a second end connected to one of the plurality of cylinder mounts. Each of the plurality of actuating mechanisms moves the associated pivot arm and the associated cylinder mount between the open configuration and the closed configuration. A plurality of pipe inserts engage the tubular in the closed configuration to prevent the tubular from moving perpendicularly to the central axis of the support frame. A plurality of carrier plates each associated with one of the plurality of pivot arms has a first side for supporting a pipe insert of the plurality of pipe inserts and a second side defines a plurality of alternately angled surfaces. A first portion of the plurality of alternately angled surfaces are angled in a first direction and a second portion of the plurality of alternately angled surfaces are angled in a second direction. A plurality of slide plates, each of the plurality of slide plates has a first side for engaging a corresponding surface on one of the plurality of pivot arms and a second side defining a plurality of alternately angled surfaces. A first portion of the plurality of alternately angled surfaces are angled in a first direction and a second portion of the plurality of alternately angled surfaces are angled in a second direction.

When the plurality of pivot arms are in the closed configuration and the tubular is moving out of the wellbore, the slide plate moves in a first direction along the pivot arm and the first portion of the plurality of alternately angled surfaces angled in the first direction of the slide plate engage the first portion of the plurality of alternately angled surfaces angled in first direction of the carrier plate to cause the pipe insert associated with the carrier plate and the slip plate to more firmly engage the tubular to prevent moving out of the wellbore. When the plurality of pivot arms are in the closed configuration and the tubular is moving into the wellbore, the slide plate moves in a second direction along the pivot arm and the second portion of the plurality of alternately angled surfaces angled in the second direction of the slide plate engage the second portion of the plurality of alternately angled surfaces angled in the second direction of the carrier plate to cause the pipe insert associated with the carrier plate and the slip plate to more firmly engage the tubular to prevent moving into the wellbore.

BRIEF DESCRIPTION OF THE DRAWINGS

For a more complete understanding, reference is now made to the following description taken in conjunction with the accompanying Drawings in which.

DETAILED DESCRIPTION

Figure 1:
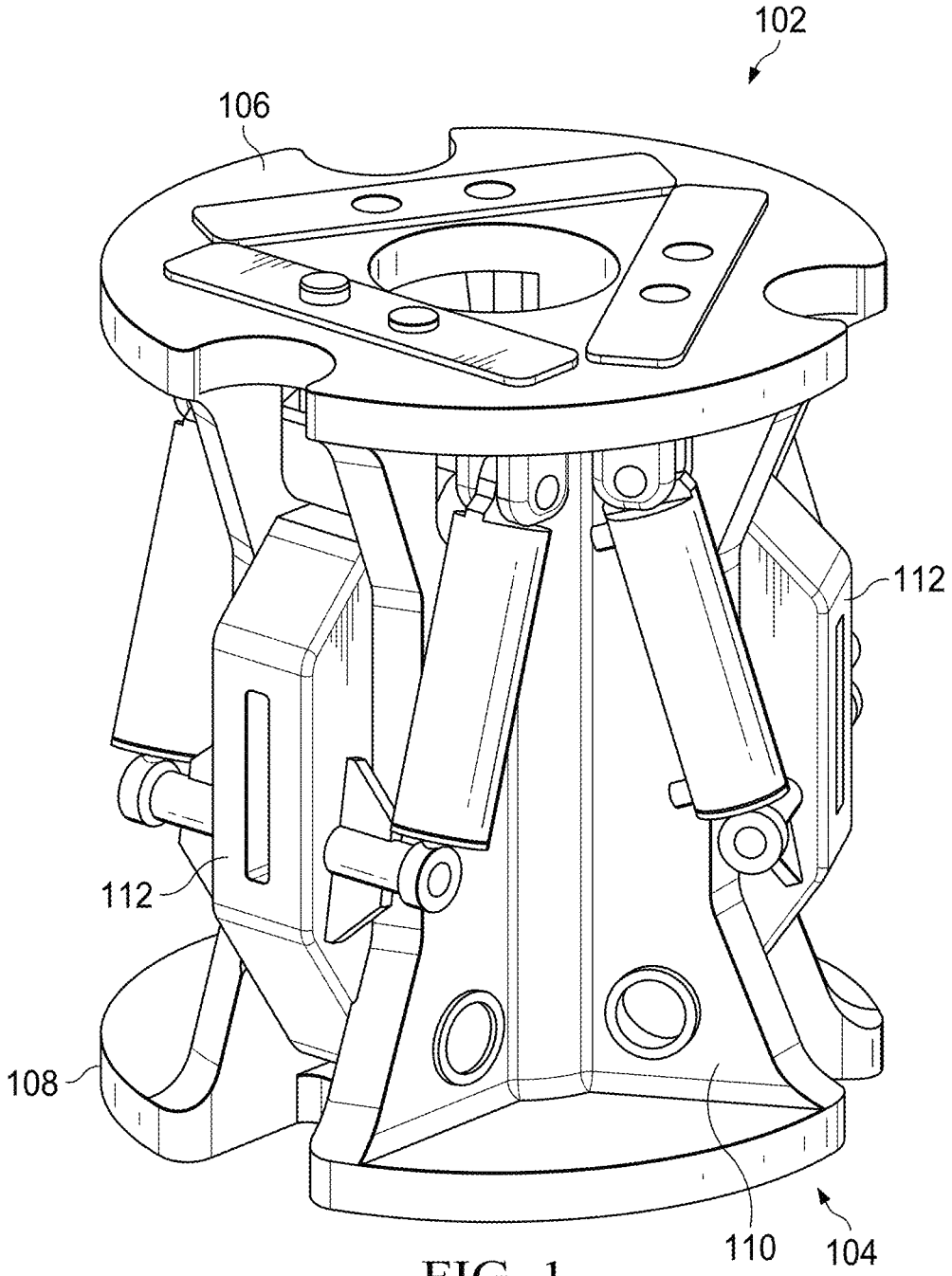
FIG. 1 illustrates a perspective view of an omnidirectional slip bowl in a closed configuration.

Referring now to the drawings, wherein like reference numbers are used herein to designate like elements throughout, the various views and embodiments of an omnidirectional slip bowl are illustrated and described, and other possible embodiments are described. The figures are not necessarily drawn to scale, and in some instances the drawings have been exaggerated and/or simplified in places for illustrative purposes only. One of ordinary skill in the art will appreciate the many possible applications and variations based on the following examples of possible embodiments.

Figure 2:
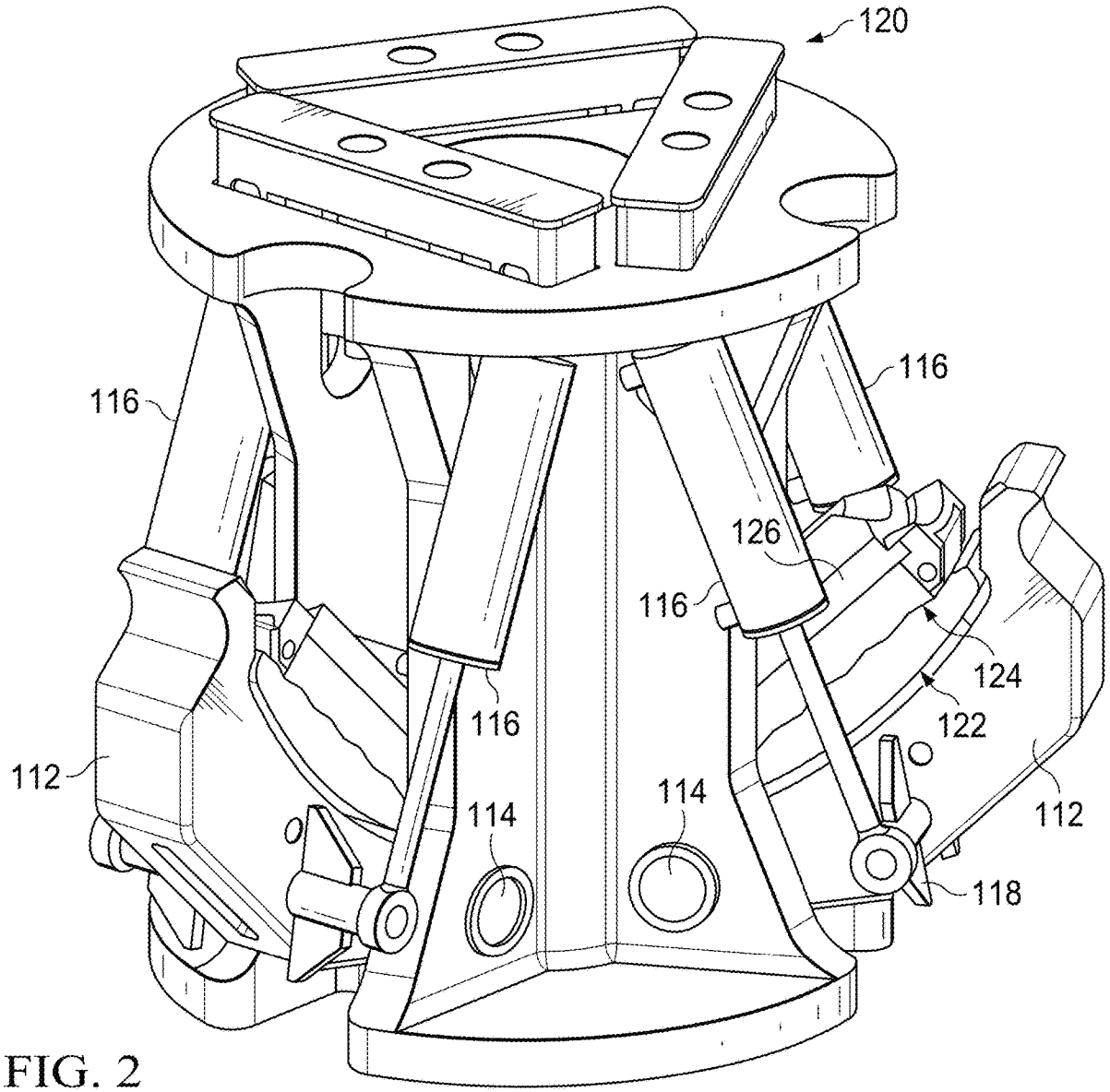
FIG. 2 illustrates a perspective view of an omnidirectional slip bowl in an open configuration.

Referring now to the drawings, and more particularly to FIGS. 1 and 2, there is illustrated perspective views of the omnidirectional slip bowl in both the closed configuration (FIG. 1) and open configuration (FIG. 2). The omnidirectional slip bowl 102 has a support frame 104 including a top plate 106 and the lower plate 108 that are interconnected by a central support frame 110. While the current embodiment illustrates a support frame other shapes of the support frame may be used. The top plate 106, the lower plate 108 and the central support frame 110 define a circular opening therein to enable tubulars to pass through the support frame 104. A number of pivot arms 112 are pivotally connected to the central support frame 110 at respective pivot pins 114. While FIGS. 1 and 2 illustrate the use of three pivot arms 112 within the slip bowl 102, it will be appreciated by one skilled in the art that a greater or lesser number of pivot arms 112 may be used for gripping tubulars inserted within the slip bowl 102 in order to prevent the tubulars from moving within the slip bowl.

The pivot arms 112 pivot between the closed position as illustrated in FIG. 1 and an open position as illustrated in FIG. 2. Each pivot arm 112 is actuated between the closed position and the open position utilizing a pair of hydraulic cylinders 116. The hydraulic cylinders 116 pivotally interconnect at a first end to the pivot arm 112 at a support bracket 118 and to a cylinder mount 120 at a second end of the hydraulic cylinder 116. When in the closed position, the slip bowl 102 is capable and rated for transmitting rotational torque loads to tubulars gripped by the slip bowl.

The pivot arm 112 has mounted thereon a slip plate 122. When the slip bowl is in the closed configuration, the slide plate 122 moves up and down along an interior arc-shaped face of the pivot arm 112 in order to maintain engagement of the slip bowl with the tubular located within the slip bowl 102. The slide plate 122 engages a carrier 124 that moves up and down along the inner face of the pivot arm 112 in association with the slide plate 122. A gripping insert 126 is mounted within the carrier 124. The gripping insert 126 includes a surface, as will be more particularly described hereinbelow, for engaging the surface of the pipe or casing that is inserted within the slip bowl 102. The gripping insert 126 prevents the tubular from moving perpendicularly to the central axis of the support frame 104 when gripping the tubular.

Figure 3:
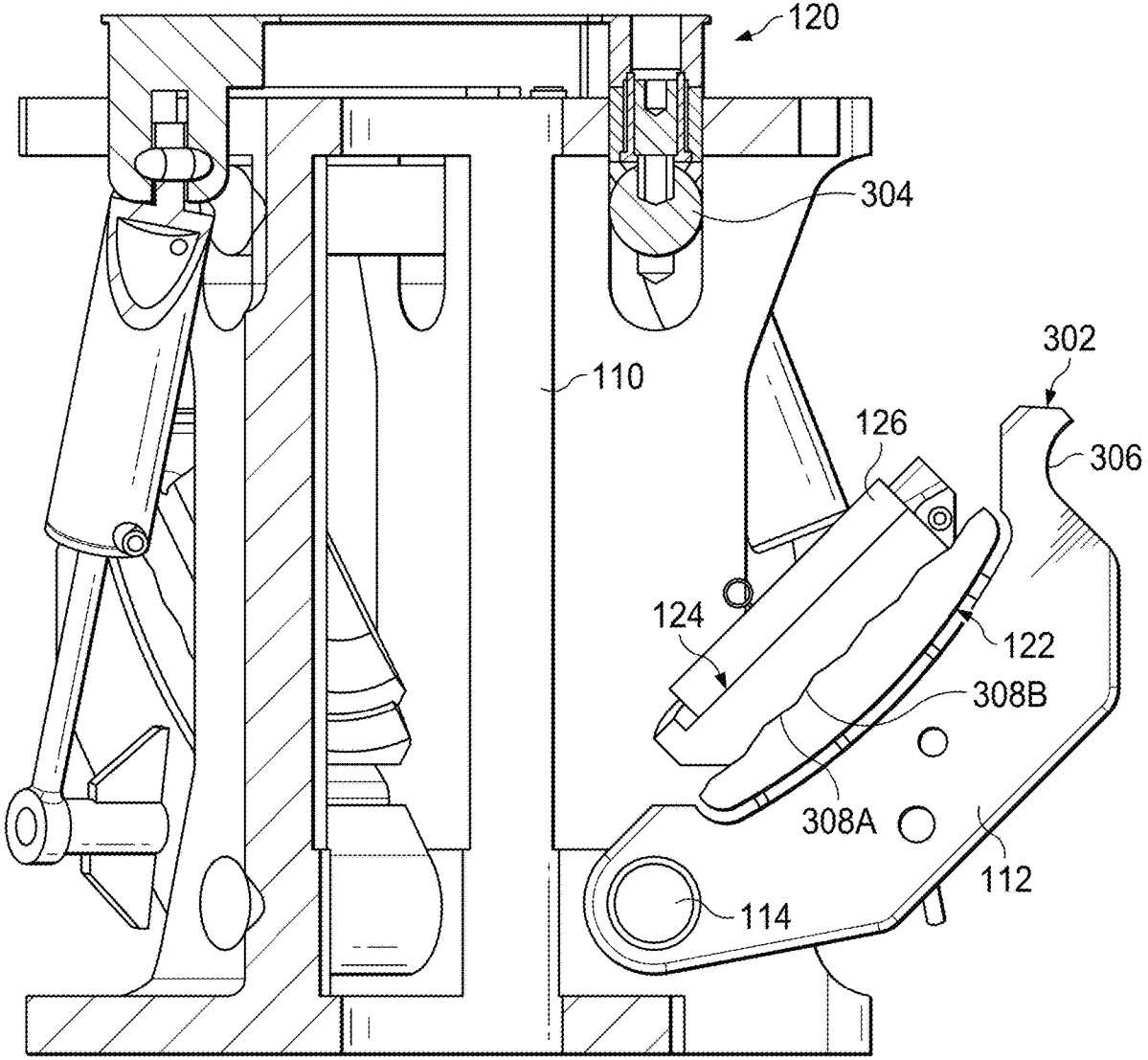
FIG. 3 illustrates a side view of the omnidirectional slip bowl of a pivot arm in an open position.

Referring now to FIG. 3, there is illustrated a cutaway side view of a pivot arm 112 in an open position. As mentioned previously, the first end of the pivot arm 112 is pivotally mounted to the central support frame 110 on a pin 114. The pivot arm 112 rotates between the open position illustrated in FIG. 3 to the closed position (FIG. 4) wherein a hook member 302 located on the second end of the pivot arm 112 opposite the first end of the pivot arm engages the cylinder mount 120. The hook member 302 defines a seat for a latching bar 304 associated with the cylinder mount 120. When the pivot arm 112 is moved to the closed position, the latching bar 304 rests within the locking face 306 of the hook member 302. As will be more fully described hereinbelow, when the slip bowl 102 is engaging a tubular with the pivot arms 112, the hook member 302 remains firmly engaged with the latching bar 304 and prevents the pivot arm 112 from pivoting from the closed position to the open position.

Figure 4:
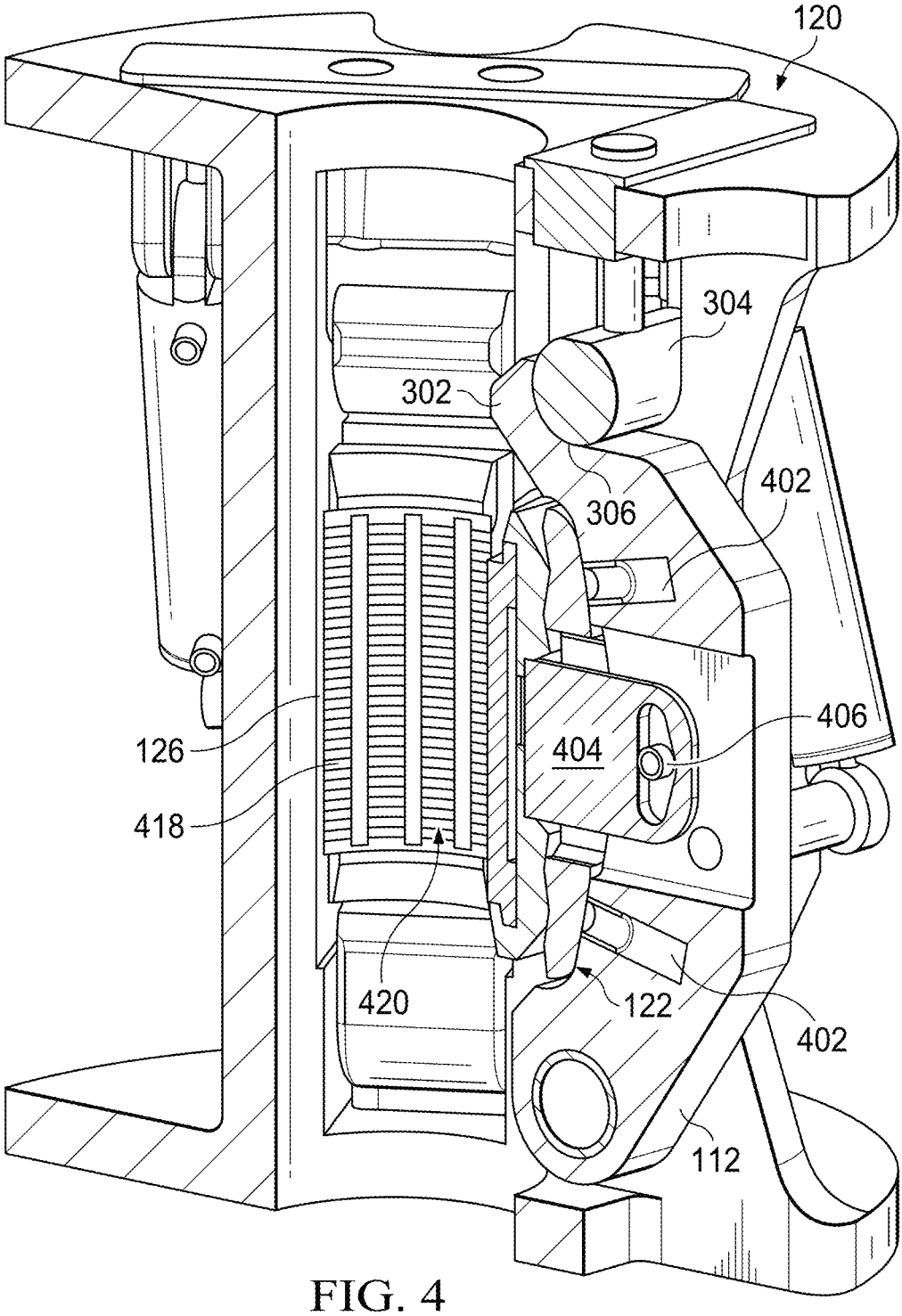
FIG. 4 illustrates a perspective view of a pivot arm in a closed position.

Referring now also to FIG. 4, a retaining arm 404 extends from the back of the carrier 124. The retaining arm 404 base inserts into a slot defined by the slide plate 122 and the pivot arm 112 and is held in place by a retaining pin 406. The retaining arm 404 enables the carrier 124 and the slide plate 122 to be held against biasing springs within the biasing spring chambers 402.

The slip plate 122 comprises an elongated member having a first side (i.e., outer face) thereof having an arcuate shape that engages with a similar arcuate shape on an interior face of the pivot arm 112. The curved shape of the outer face of the slide plate 122 and the corresponding curved shape of the inner face of the pivot arm 112 enable the slide plate to move up and down along the pivot arm 112. The arcuate shape of the slip plate 122 allows the carrier 124 to self-adjust and remain parallel to the centerline of the tubular in the wellbore. If for instance, the tubular was significantly undersized or the gripping insert worn and dull, the pivot arms 112 would travel further than nominal towards the centerline of the tubular before the insert would meet the tubular. Without the circular surface the gripping insert 126 would only contact the tubular at the insert's top edge. The circular sliding surface of the slip plate 122 allows the carrier 124 to shift with respect to the pivot arm 112 and align with the surface/centerline of the tubular. As the pivot arm 112 pivots closer to the centerline of the tubular, the slip plate 122 will remain parallel to the centerline tubular and drop down closer to the pivot of the pivot arm as it slides along the circular surface. The slip bowl cylinders 116 will position the pivot arms 112 until the gripping inserts 126 contact the tubular and the pre-load springs have been fully compressed. Then as the slip bowl is loaded, the angles on the second surface of the slip plate 122 will force the pivot arm 112 out until the hook 302 rests against the locking pin 304.

A second side (i.e., inner face) of the slide plate 122 defines a series of alternating angled surfaces 308 that are angled in a first direction 308A or a second direction 308B. By providing the alternating angled surfaces 308, the slide plate 122 allows movement of the carrier 124 and gripping insert 126 to enable the gripping insert to grip and hold a section of tubular in both of out-hole and in-hole directions. In this manner, the same group of pivot arms 112 and a single slip bowl 102 can prevent the tubular from moving in either direction in or out of the wellbore.

Referring now to FIG. 4, there is illustrated a cross-sectional perspective view through the center of the pivot arm 112. The cross-sectional view illustrates the pivot arm 112 in the locked position with respect to the latching bar 304 of the cylinder mount 120. The latching bar 304 is secured to the locking face 306 of the hook member 302. The pivot arm 112 further defines a pair of slide plate biasing chambers 402 into which preload springs are inserted for biasing the slide plate 122 outward from the pivot arm 112.

FIG. 4 also more particularly illustrates the pipe teeth 418 of the gripping inserts 126. Each of the gripping inserts 126 have a curved inner face 420 that is similar to the surface of a tubular to be gripped by the omnidirectional slip bowl 102. The curved outer face 420 includes a plurality of teeth therein that enable frictional engagement between the gripping insert 126 and a tubular. The gripping inserts 126 are made of material with a hardness value equal to or greater than the tubular to be gripped. The teeth 418 may also comprise a replaceable insert that may be periodically replaced as the teeth 418 wear down from repeated use. The gripping inserts 126 may comprise teeth, a grit face or even a smooth face depending on the application. The pipe inserts are selected based on the type and size of tubular being gripped by the slip bowl.

Figure 5:
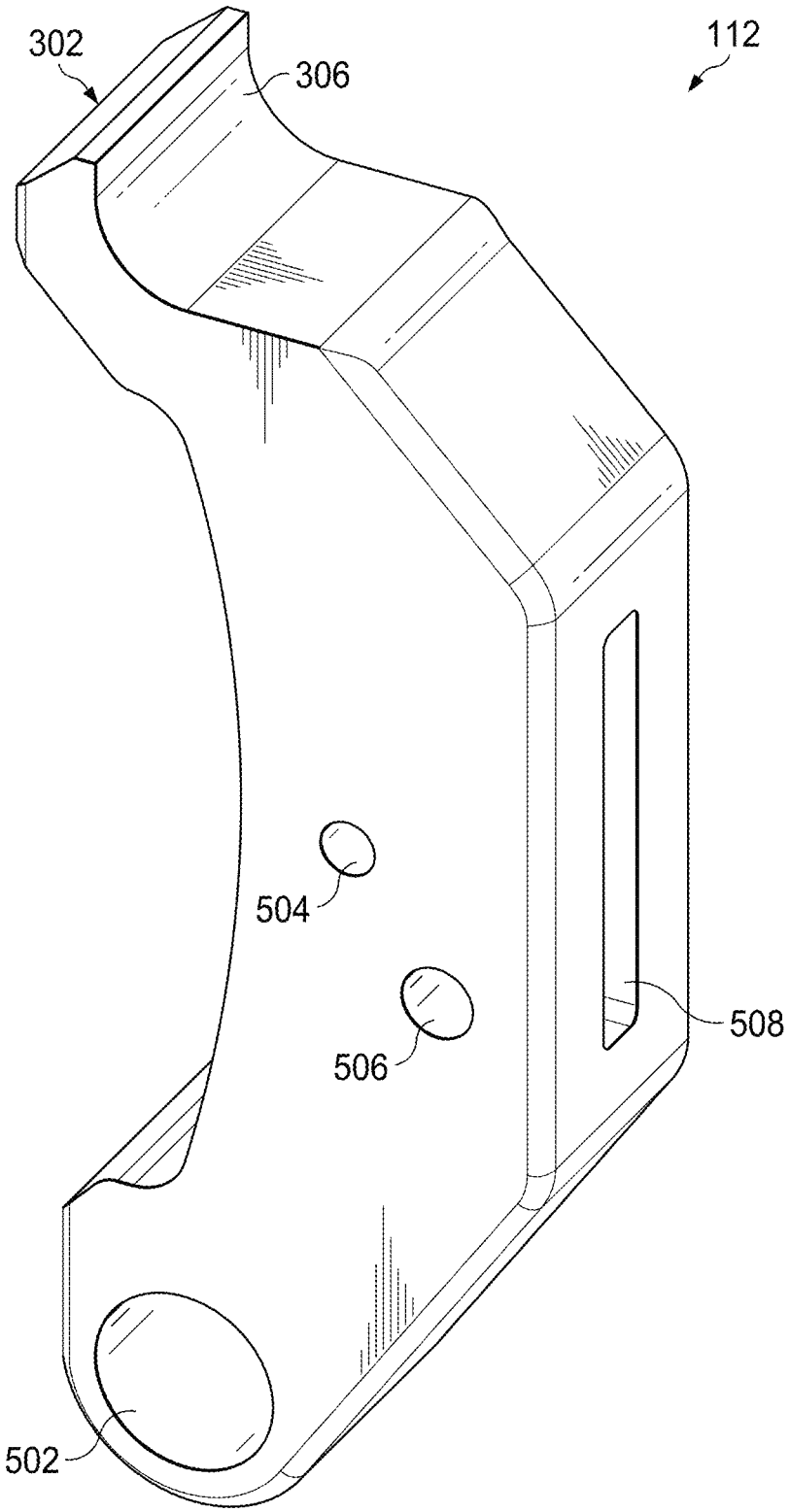
FIG. 5 illustrates a perspective view of the pivot arm.

FIG. 5 more particularly illustrates a perspective view of only the pivot arm 112. As discussed previously, a first end of the pivot arm 112 defines an opening 502 for receiving a pin 114 that is inserted through the pivot arm and the central support frame 110 to enable the pivot arm 112 to pivot between the open position and a closed position. The pivot arm 112 further defines a retainer clip opening 504 through which retaining pin 406 may be inserted to secure the retaining arm 404 that secures the carrier 124 and the slide plate 124 to the pivot arm 112. A further opening 506 is defined on each side of the pivot arm 112 for receiving a pin (i.e., through the support 118) to secure the hydraulic cylinder 116 to the pivot arm 112 to enable movement between the open position and a closed position as described hereinabove. The second end of the pivot arm 112 includes the hook member 302 for securing to the latching bar 304 of the cylinder mount 120. The cylinder mount engages with locking face 306 to maintain the pivot arm 112 in the closed position when a tubular is being gripped by the slip bowl 102. The pivot arm 112 further includes a retaining slot 508 for receiving the retaining arm 404. The retaining arm 404 inserts through a slot in the slide plate 122 in order to maintain the slide plate against the biasing springs inserted into the biasing chambers 402.

Figure 6:
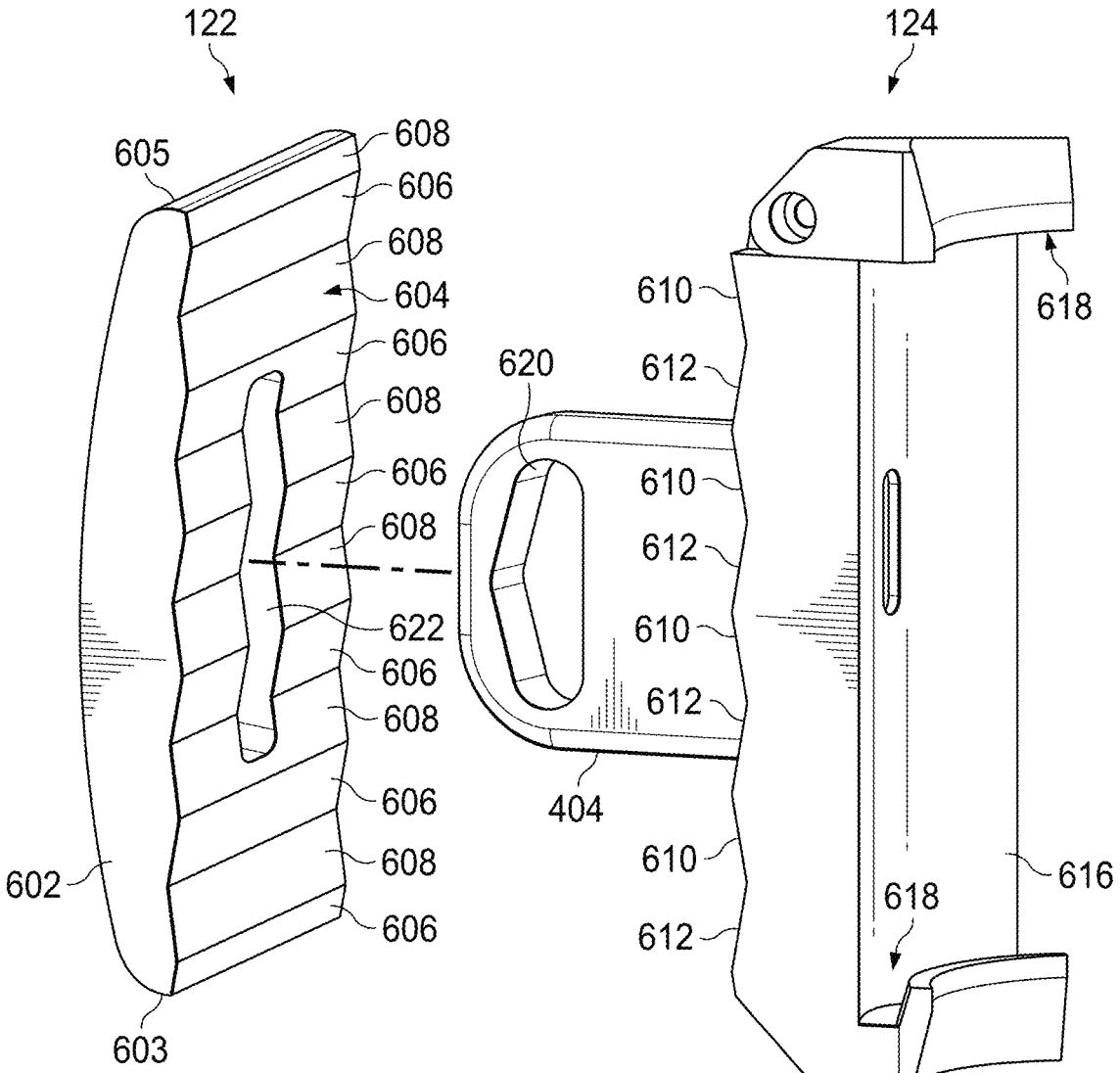
FIG. 6 illustrates a perspective view of the slide plate and carrier assemblies.

Referring now to FIG. 6, there is illustrated a perspective view of the slide plate 122 and the carrier 124. The slide plate 122 has a slight arcuate shape from a first end 603 to a second end 605 thereof. An outer face 602 of the slide plate 122, which rests against the pivot arm 112 defines a smooth arc from the first end 603 to the second end 605. An inner face 604 of the slide plate 122 includes a series of oppositely angled surfaces 606 and 608 to create a series of peaks and valleys on the inner face. A first portion 606 of the surfaces are angled in a first direction while a second portion 608 of the surfaces are angled in a second direction. The oppositely angled surfaces enable the slide plate 122 to configure the slip bowl to engage and grip the tubular that is either being pushed down into a wellbore or pulled out of the well bore. When the slip bowl 102 is gripping a tubular within the slip bowl and the weight of the tubular is pulling the pipe down into the wellbore, the second angled faces 608 of the slip plate 122 are wedgingly engaged with adjoining faces of the carrier 124. In this pipe-heavy situation, the greater the downward movement of the carrier 124 relative to the slide plate 122, the greater the lateral wedging force produced between the second angled faces 608 of the slide plate 122 and the adjacent angled faces of the carrier 124. This wedging force pushes the carrier 124 and gripping insert 126 against the tubular while simultaneously pushing the slide plate 122 and pivot arm 112 away from the tubular. Similarly, when the slip bowl 102 is gripping a tubular that is being forced upward out of the wellbore, the first angled surfaces 606 of the slide plate 122 wedgingly engage adjoining angled surfaces on the carrier 124 to prevent movement of the tubular out of the slip bowl 102. In this pipe-light situation, the greater the upward movement of the carrier 124 relative to the slide plate 122, the greater the lateral wedging force produced between the first angled faces 606 of the slide plate 122 and the adjacent angled faces of the carrier 124.

As further described herein, when the slip 102 is gripping the tubular in either a pipe-heavy or pipe-light configuration, the outward lateral force on the pivot arm 112 caused by the wedging action between the slide plate 122 and carrier 124 is transmitted up the pivot arm to the hook member 302, causing the hook member to likewise exert an outward lateral force against the latching bar 304. The greater the wedging force on the pivot bar 112, the greater the locking force between the hook member 302 and the latching bar 304, regardless of whether the load is from a pipe-heavy or pipe-light situation. This interlocking relationship helps ensure the latching bar 304 cannot disengage from the hook member 302 and open the slip 102 when a significant load is present.

The carrier 124 includes on an outer face 609 thereof a series of oppositely angled surfaces 610 and 612. A first portion 610 of the surfaces are angled in a first direction while a second portion 612 of the surfaces are angled in a second direction to provide a series of peaks and valleys and, when in an unloaded configuration, where the peaks of the carrier plate substantially align with the valleys of the slide plate 122 and the valleys of the carrier substantially align with the peaks of the slide plate. The oppositely angled surfaces enable the carrier 124 to configure the slip bowl 102 to engage and grip a tubular that is either being pushed down into a wellbore or pulled out of the wellbore. When the slip bowl 102 is gripping a tubular within the slip bowl and the weight of the string is pulling the pipe down into the wellbore, the first angled faces 610 of the carrier 124 are wedgingly engaged with an adjoining angled faces 608 of the slide plate 602. Similarly, when the slip bowl 102 is gripping tubular that is being forced upward out of the wellbore, the second angled surfaces 612 of the carrier 124 wedgingly engage adjoining angled surfaces 610 on the slide plate 122 to prevent movement of the tubular out of the slip bowl. The inner surface 616 of the carrier 124 includes slots 618 for receiving the gripping inserts 126 that directly engage the tubular and a pivoting member 128 to secure a gripping insert 126 into the carrier 124. The carrier 124 has extending perpendicularly from the back thereof a retaining arm 404 defining an opening 620 therein that is inserted through a slot 622 defined within the slide plate 122. As described hereinabove, when the retaining arm 404 is inserted through the slot 622 of the slide plate 602 and further through a corresponding slot 508 within the pivot arm 112, a pin may be used to insert through the pivot arm and the opening 620 to retain the carrier 124 and slide plate 122 against the pivot arm 112.

In some embodiments, the wedging surfaces on the slide plate 122 and carrier 124 each comprise at least one set of first and second flat surfaces, where each respective first flat surface is angled at a constant positive slope and each respective second flat surface is angled at a constant negative slope (with the slopes being measured relative to a median line on the respective wedging surface). In some such embodiments, multiple sets of first and second flat surfaces are arranged consecutively along the wedging surfaces (also known as "sawtooth" profile). For example, in the embodiment of FIG. 6, the wedging surfaces on the slide plate 122 and carrier 124 each comprise at least four adjacent sets of first and second flat surfaces arranged consecutively, where each respective first flat surface is angled at a constant positive slope and each respective second flat surface is angled at a constant negative slope. In other embodiments, the wedging surfaces on the slide plate 122 and carrier 124 each comprise a continuously curving surface having at least a first curved region of positive slope and a second curved region of negative slope. In some such embodiments, the wedging surfaces on the slide plate 122 and carrier 124 each comprise a continuously curving surface having multiple alternating portions of positive slope and negative slope. In some such embodiments, the wedging surfaces on the slide plate 122 and carrier 124 each comprise a repeating sine curve having multiple alternating portions of positive slope and negative slope. In still further embodiments, the wedging surfaces on the slip plate 122 and carrier 124 comprise other profiles that, when placed in contact with one another and moved relative to one another along a travel line, cause wedging engagement with one another producing a lateral force between the wedging surfaces, wherein the direction of the lateral force is the same when the direction of movement along the travel line is positive or negative.

Figure 7:
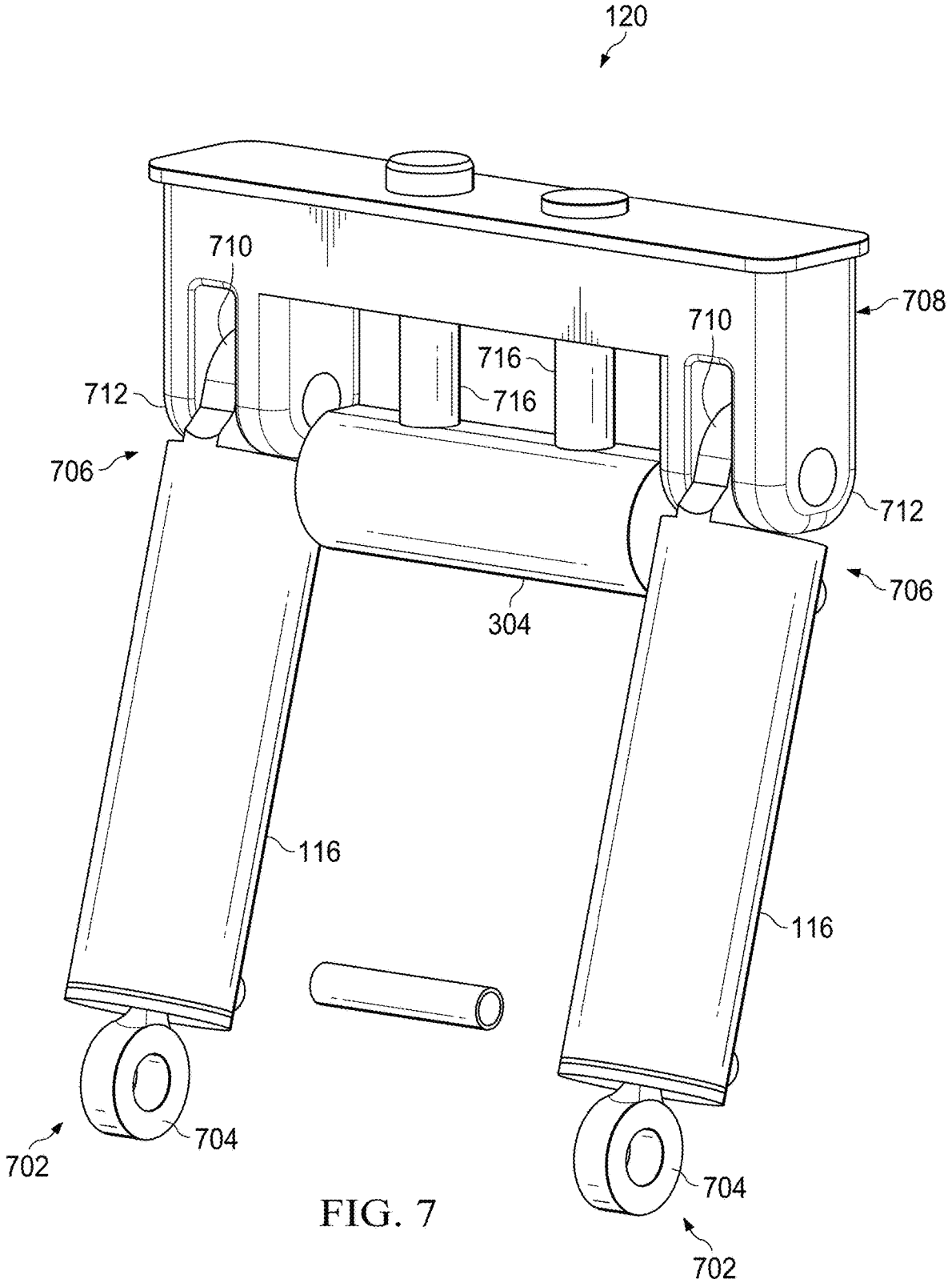
FIG. 7 illustrates a perspective view of the carrier mount.

Referring now to FIG. 7, there is illustrated the cylinder mount 120. The cylinder mount 120 includes a pair of hydraulic cylinders 116. The cylinders include a first end 702 defining a piston arm connector 704 that interconnect with the pivot arms 112. The second end 706 of the hydraulic cylinder 116 connects with the cylinder mount 120 at a flange 710 that inserts into a U-shaped connector 712 that extends downward from the cylinder mount 120. The cylinder mount 120 comprises a substantially rectangularly shaped member 708 from which the U-shaped connectors hang downward to engage the hydraulic cylinders 116. A pin is inserted through the U-shaped connector 712 and the flange 710 in order to interconnect the hydraulic cylinder 116 to the cylinder mount 120. The locking bar 304 extends downward from the cylinder mount 120 from a pair of cylindrical members 716. The cylindrical members 716 extend downward from the cylinder mount 120 to maintain the locking bar 304 a fixed distance below the rectangular structure of the cylinder mount 120. The cylindrical members 716 are spring biased using nitrogen gas springs in one embodiment but other biasing mechanisms may be used. The locking bar 304 when engaged by the hook 306 of the pivot arm 112 maintains the pivot arms in a locked position when the slip bowl is bearing a string weight as more particularly described in FIG. 8.

Figure 8:
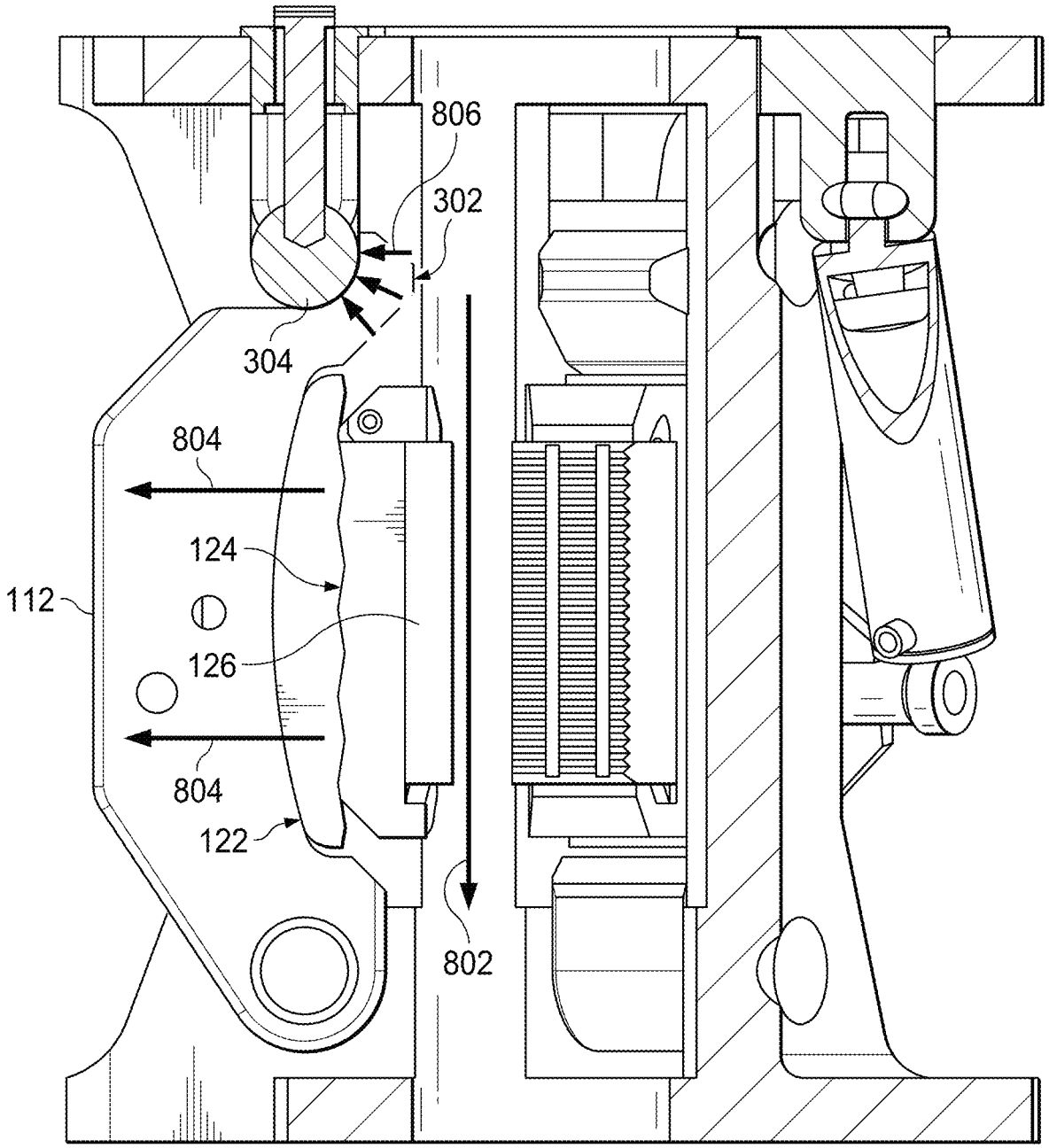
FIG. 8 illustrates the forces that lock a pivot arm to a locking bar responsive to tubular string weight.

When the pivot arms 112 are in a closed position and the slip bowl 102 is supporting a tubular from either falling into or pushing out of a wellbore, the cylinder mount 120 locks the pivot arms in the closed position. This is more particularly illustrated in FIG. 8. When a pivot arm 112 is in a closed position and the tubular (not shown) is engaged by the gripping inserts 126, the forces within the omnidirectional slip bowl 102 are as illustrated in FIG. 8.

Once there is tubular string weight held by the slip bowl 102, the tubular weight may in one embodiment provide a downward force in the direction shown by arrow 802. The downward force 802 of the tubular weight forces the carriers 124 to move downward relative to the slide plates 122 causing the adjoining angled surfaces to wedge against one another and produce an outward lateral force on the slide plates 122 shown by arrow 804. This causes the slide plate 122 to provide a lateral force on the pivot arms 112 in the direction illustrated by arrows 804. The lateral force 804 upon the pivot arm 112 also causes a lateral force between the hook 302 at the top of the pivot arm 112 and the latching bar 304 as illustrated generally by the arrows 806. The lateral force causes frictional forces between the hook 302 and latching bar 304 to help lock the latching bar in place and keep the cylinders 116 from being able to unlatch the pivot arms 112 when tubular weight is present in either direction.

It will be appreciated by those skilled in the art having the benefit of this disclosure that this omnidirectional slip bowl provides a single slip bowl for supporting tubular weight either down into or out of the drill hole. It should be understood that the drawings and detailed description herein are to be regarded in an illustrative rather than a restrictive manner, and are not intended to be limiting to the particular forms and examples disclosed. On the contrary, included are any further modifications, changes, rearrangements, substitutions, alternatives, design choices, and embodiments apparent to those of ordinary skill in the art, without departing from the spirit and scope hereof, as defined by the following claims. Thus, it is intended that the following claims be interpreted to embrace all such further modifications, changes, rearrangements, substitutions, alternatives, design choices, and embodiments.

What is claimed is:

1. An omnidirectional slip bowl comprising:

a support frame having a central axis and defining an opening therein to receive a tubular passing into or coming out of a wellbore;

a plurality of pivot arms for moving between an open configuration and a closed configuration;

a plurality of cylinder mounts slidably engaging the support frame and moving between the open configuration and the closed configuration, each of the plurality of cylinder mounts associated with one of the plurality of pivot arms;

a plurality of actuators each having a first end connected to one of the plurality of pivot arms and a second end connected to one of the plurality of cylinder mounts, wherein each of the plurality of actuators moves the associated pivot arm and the associated cylinder mount between the open configuration and the closed configuration;

a plurality of pipe inserts for engaging the tubular in the closed configuration to prevent the tubular from moving perpendicular to the central axis of the support frame;

a plurality of carriers each associated with one of the plurality of pivot arms having a first side for supporting a pipe insert of the plurality of pipe inserts and a second side defining a first plurality of alternately angled surfaces, wherein a first portion of the first plurality of alternately angled surfaces are angled in a first direction and a second portion of the first plurality of alternately angled surfaces are angled in a second direction;

a plurality of slide plates, each of the plurality of slide plates having a first side for engaging a corresponding surface on one of the plurality of pivot arms and a second side defining a second plurality of alternately angled surfaces, wherein a first portion of the second plurality of alternately angled surfaces are angled in the first direction and a second portion of the second plurality of alternately angled surfaces are angled in the second direction;

wherein when the plurality of pivot arms are in the closed configuration and the tubular is moving out of the wellbore, the plurality of slide plates move in a third direction along the plurality of pivot arms and the first portion of the second plurality of alternately angled surfaces angled in the first direction of the plurality of slide plates engage the first portion of the second plurality of alternately angled surfaces angled in the first direction of the plurality of carriers to cause the plurality of pipe inserts associated with the plurality of carriers and the plurality of slide plates to more firmly engage the tubular to prevent the tubular moving out of the wellbore; and wherein when the plurality of pivot arms are in the closed configuration and the tubular is moving into the wellbore, the plurality of slide plates move in a fourth direction along the plurality of pivot arms and the second portion of the second plurality of alternately angled surfaces angled in the second direction of the plurality of slide plates engage the second portion of the second plurality of alternately angled surfaces angled in the second direction of the plurality of carriers to cause the plurality of pipe inserts associated with the plurality of carriers and the plurality of slide plates to more firmly engage the tubular to prevent the tubular moving into the wellbore.

2. The omnidirectional slip bowl of claim 1, wherein the first side of the plurality of slide plates further comprise an arcuate surface enabling the plurality of slide plates to move between a first position when the tubular is moving out of the wellbore and a second position when the tubular is moving into the wellbore.

3. The omnidirectional slip bowl of claim 2, wherein the arcuate surface of the plurality of slide plates enables the plurality of slide plates to move along the plurality of pivot arms to enable the plurality of carriers engaging the plurality of slide plates to self-adjust and remain parallel to a centerline of the tubular.

4. The omnidirectional slip bowl of claim 1, wherein each of the plurality of cylinder mounts further comprises:

a member for slidably engaging a top surface of the support frame in a direction parallel to the central axis of the support frame;

a u-shaped connector located at each end of the member and integrally connected therewith for connecting the plurality of cylinder mounts with the plurality of actuators; and a locking bar connected to the member and extending downward therefrom, wherein the locking bar engages a pivot arm of the plurality of pivot arms in the closed configuration to maintain the pivot arm in the closed configuration.

5. The omnidirectional slip bowl of claim 4, wherein the pivot arm maintains a locking connection with the locking bar by increasing forces between the pivot arm and the locking bar responsive to tubular weight forces applied to the omnidirectional slip bowl.

6. The omnidirectional slip bowl of claim 1, wherein the plurality of carriers further comprises:

a retaining member extending from the second side of the plurality of carriers into a first opening defined within the plurality of slide plates and a second opening defined within the plurality of pivot arms; and a retaining pin for insertion through the plurality of pivot arms and the retaining member to secure the plurality of carriers and the plurality of slid plates to the plurality of pivot arms.

7. The omnidirectional slip bowl of claim 1 further comprising:

wherein the plurality of pivot arms further defines a plurality of bias spring chambers therein; and a bias spring inserted into each of the bias spring chambers, wherein the bias spring biases the second side of the plurality of slide plates to engage the second side of the plurality of carriers.

8. The omnidirectional slip bowl of claim 1, wherein when each of the plurality of pivot arms are in the closed configuration, the omnidirectional slip bowl transmits rotation torque loads to the tubular.

9. An omnidirectional slip bowl comprising:

a support frame having a central axis and defining an opening therein to receive a tubular passing into or coming out of a wellbore;

a plurality of pivot arms for moving between an open configuration and a closed configuration;

a plurality of actuators each having a first end connected to one of the plurality of pivot arms, wherein each of the plurality of actuators moves the associated pivot arm between the open configuration and the closed configuration;

a plurality of gripper assemblies, each gripper assembly associated with one of the plurality of pivot arms for locking the tubular in a fixed position and prevent movement of the tubular from moving into or out of the wellbore;

wherein when the plurality of pivot arms are in the closed configuration and the tubular is moving out of the wellbore, the plurality of gripper assemblies move in a first direction along the plurality of pivot arms and engage the tubular to prevent moving out of the wellbore; and wherein when the plurality of pivot arms are in the closed configuration and the tubular is moving into the wellbore, the plurality of gripper assemblies move in a second direction along the pivot arm and engage the tubular to prevent moving into the wellbore.

10. The omnidirectional slip bowl of claim 9, wherein each of the plurality of gripper assemblies further comprises:

a pipe insert for engaging the tubular in the closed configuration to prevent the tubular from moving perpendicular to the central axis of the support frame;

a carrier associated with one of the plurality of pivot arms has a first side for supporting the pipe insert and a second side defining a first plurality of alternately angled surfaces, wherein a first portion of the first plurality of alternately angled surfaces are angled in a first direction and a second portion of the first plurality of alternately angled surfaces are angled in a second direction; and a slide plate having a first side for engaging a corresponding surface on one of the plurality of pivot arms and a second side defining a second plurality of alternately angled surfaces, wherein a first portion of the second plurality of alternately angled surfaces are angled in the first direction and a second portion of the second plurality of alternately angled surfaces are angled in the second direction.

11. The omnidirectional slip bowl of claim 10, wherein the first side of the slide plate comprises an arcuate surface enabling the slide plate to move between a first position when the tubular is moving out of the wellbore and a second position when the tubular is moving into the wellbore.

12. The omnidirectional slip bowl of claim 11, wherein the arcuate surface of the slide plate enables the slide plate to move along the pivot arm to enable the carrier engaging the slide plate to self-adjust and remain parallel to a centerline of the tubular.

13. The omnidirectional slip bowl of claim 10 further comprising:

wherein when the slide plate moves in a first direction along the pivot arm and the first portion of the second plurality of alternately angled surfaces angled in the first direction of the slide plate engage the first portion of the plurality of alternately angled surfaces angled in first direction of the carrier to cause the pipe insert associated with the carrier and the slide plate to more firmly engage the tubular to prevent moving out of the wellbore; and wherein when the slide plate moves in a second direction along the pivot arm and the second portion of the second plurality of alternately angled surfaces angled in the second direction of the slide plate engage the second portion of the plurality of alternately angled surfaces angled in the second direction of the carrier to cause the pipe insert associated with the carrier and the slide plate to more firmly engage the tubular to prevent moving into the wellbore.

14. The omnidirectional slip bowl of claim 10 further comprising:

a plurality of cylinder mounts slidably engaging the support frame and moving between the open configuration and the closed configuration, each of the plurality of cylinder mounts associated with one of the plurality of pivot arms, wherein each of the plurality of cylinder mounts further comprises:

a member for slidably engaging a top surface of the support frame in a direction parallel to the central axis of the support frame;

a u-shaped connector located at each end of the member and integrally connected therewith for connecting the plurality of cylinder mounts with the plurality of actuators; and a locking bar connected to the member and extending downward therefrom, wherein the locking bar engages a pivot arm in the closed configuration to maintain the pivot arm in the closed configuration.

15. The omnidirectional slip bowl of claim 14, wherein the pivot arm maintains a locking connection with the locking bar by increasing forces between the pivot arm and the locking bar responsive to tubular weight forces applied to the omnidirectional slip bowl.

16. The omnidirectional slip bowl of claim 10, wherein the carrier further comprises:

a retaining member extending from the second side of the carrier into a first opening defined within the slide plate and a second opening defined within the pivot arm; and a retaining pin for insertion through the pivot arm and the retaining member to secure the carrier and the slid plate to the pivot arm.

17. The omnidirectional slip bowl of claim 10 further comprising:

wherein the pivot arm further defines a plurality of bias spring chambers therein; and a bias spring inserted into each of the bias spring chambers, wherein the bias spring biases the second side of the slide plate to engage the second side of the carrier.

18. An omnidirectional slip bowl comprising:

a support frame having a central axis and defining an opening therein to receive a tubular passing into or coming out of a wellbore;

a plurality of pivot arms for moving between an open configuration and a closed configuration;

a plurality of actuators each having a first end connected to one of the plurality of pivot arms, wherein each of the plurality of actuators moves the associated pivot arm between the open configuration and the closed configuration;

a plurality of pipe inserts each associated with one of the plurality of pivot arms for engaging the tubular in the closed configuration to prevent the tubular from moving perpendicular to the central axis of the support frame;

a plurality of carriers each associated with one of the plurality of pivot arms having a first side for supporting one of the plurality of pipe inserts and a second side defining a plurality of alternately angled surfaces, wherein a first portion of the plurality of alternately angled surfaces are angled in a first direction and a second portion of the plurality of alternately angled surfaces are angled in a second direction; and a plurality of slide plates each having an arcuate side for engaging a corresponding surface on one of the plurality of pivot arms and a second side defining a plurality of alternately angled surfaces, wherein a first portion of the plurality of alternately angled surfaces are angled in a first direction and a second portion of the plurality of alternately angled surfaces are angled in a second direction, wherein the arcuate side of the plurality of slide plates enables the plurality of slide plates to move along the plurality of pivot arms to enable the plurality of carriers engaging the plurality of slide plates to self-adjust and remain parallel to a centerline of the tubular;

wherein when the plurality of slide plates move in a first direction along the pivot arm and the first portion of the plurality of alternately angled surfaces angled in the first direction of the plurality of slide plates engage the first portion of the plurality of alternately angled surfaces angled in first direction of the plurality of carriers to cause the plurality of pipe inserts associated with the plurality of carriers and the plurality of slide plates to more firmly engage the tubular to prevent moving out of the wellbore;

wherein when the plurality of slide plates move in a second direction along the plurality of pivot arms and the second portion of the plurality of alternately angled surfaces angled in the second direction of the plurality of slide plates engage the second portion of the plurality of alternately angled surfaces angled in the second direction of the plurality of carriers to cause the plurality of pipe inserts associated with the plurality of carriers and the plurality of slide plates to more firmly engage the tubular to prevent moving into the wellbore;

a plurality of cylinder mounts slidably engaging the support frame and moving between the open configuration and the closed configuration, each of the plurality of cylinder mounts associated with one of the plurality of pivot arms, wherein each of the plurality of cylinder mounts further comprises:

a member for slidably engaging a top surface of the support frame in a direction parallel to the central axis of the support frame;

a u-shaped connector located at each end of the member and integrally connected therewith for connecting the plurality of cylinder mounts with the plurality of actuators; and a locking bar connected to the member and extending downward therefrom, wherein the locking bar engages a pivot arm in the closed configuration to maintain the pivot arm in the closed configuration.

19. The omnidirectional slip bowl of claim 18, wherein the first side of the plurality of slide plates comprises an arcuate surface enabling the plurality of slide plates to move between a first position when the tubular is moving out of the wellbore and a second position when the tubular is moving into the wellbore.

20. The omnidirectional slip bowl of claim 18, wherein the pivot arm maintains a locking connection with the locking bar by increasing forces between the pivot arm and the locking bar responsive to tubular weight forces applied to the omnidirectional slip bowl.

* * * * *